United States Patent [19]

Cox

[11] 4,328,784

[45] May 11, 1982

[54] WOOD AND COAL BURNING HEATING UNIT

[76] Inventor: Kenneth K. Cox, P.O. Box 585, Hurricane, Utah 84737

[21] Appl. No.: 112,000

[22] Filed: Jan. 14, 1980

[51] Int. Cl.[3] ..... F24B 3/00; F24C 1/14

[52] U.S. Cl. ..... 126/67; 126/61; 126/66

[58] Field of Search ..... 126/61, 63, 66, 67, 126/110 B

[56] References Cited

U.S. PATENT DOCUMENTS

| | | | |
|---|---|---|---|
| 4,050,441 | 9/1977 | Horwinski | 126/66 |
| 4,204,517 | 5/1980 | Rumsey | 126/66 |
| 4,206,743 | 6/1980 | Niemela | 126/61 |

*Primary Examiner*—Samuel Scott
*Assistant Examiner*—Wesley S. Ratliff, Jr.
*Attorney, Agent, or Firm*—Terry M. Crellin; B. Deon Criddle

[57] ABSTRACT

A wood and coal burning heating unit is provided for heating a residential building or the like. The unit includes a firebox having a double wall on its rear and top sections, with the back chamber and top chamber, which are formed between the respective double walls, being connected in flow communication. Air is blown into the back chamber, flows through the back chamber and top chamber and is expelled through a substantially horizontal, rectangular opening at the front of heating unit. A plurality of elongate, upstanding fins are provided in the top chamber so that the air flowing through the top chamber flows along the upstanding surfaces of the fins. Heat is conducted through the fins from the inner top wall of the firebox and is then transferred from the fins to the air flowing along the surfaces of the fins.

4 Claims, 4 Drawing Figures

WOOD AND COAL BURNING HEATING UNIT

BACKGROUND OF THE INVENTION

1. Field

The invention relates to wood and coal burning heating units having a heat collecting jacket surrounding the combustion chamber and a means for forcing air through the jacket and into a room.

2. State of the Art

Heating units adapted for burning wood or coal are well known and in common use. Such units may consist of a combustion chamber having an air heating jacket juxtaposed at least a portion of the firebox. Room air is heated by being circulated through the heating jacket.

U.S. Pat. Nos. 1,681,449; 2,134,935; 2,743,720; and 3,981,292 each disclose hot air circulating systems comprising a jacket at the rear of the firebox, with conduits or a second jacket at the top of the firebox in communication with the jacket at the rear of the firebox. Air flows from the jacket at the rear of the firebox, through the conduits or second jacket at the top of the firebox and into the room which is to be heated.

U.S. Pat. No. 4,092,976 discloses a heating unit comprising a firebox having double walls at its back, sides and bottom and a single wall at its top and front. A fan is provided in the back wall for forcing air through the air channels formed by the double walled sections of the heating unit. Baffles are provided in the air channels to direct the forced air from the fan to vents in the front of the heating unit.

OBJECTIVES

It is a principle objective of the present invention to provide a heating unit for burning wood or coal, wherein the firebox has double walls at the rear and top thereof which form interconnected chambers for heating air which flows therethrough. An additional objective is to provide heat transferring fins welded directly to the outer surface of the top wall of the firebox, with the fins projecting upwardly from the top of the firebox into the air flow chamber, whereby heat is conducted through the fins from the top of the combustion chamber and is then transferred from the fins to the air flowing thereby.

BRIEF DESCRIPTION OF THE INVENTION

Principle features of the present invention in a wood or coal burning heating unit include a firebox that is generally of rectangular configuration with sides, back, bottom, top and partially open front wall. A door is provided on the front wall to close the opening therein. The size of the firebox and its shape can be varied according to individual requirements for each heating unit. The firebox is provided with a chimney opening for exhausting combustion gases therefrom.

An air chamber, hereinafter referred to as the back air chamber, is formed abutting the outside of the firebox at the back of the firebox. The back air chamber is formed by an outer back wall which is spaced from the back wall of the firebox. The back air chamber is provided with an intake opening near the bottom thereof, and an electric fan is associated with the intake opening to blow air through the duct and into the back air chamber. Another air chamber, hereinafter referred to as the top air chamber, is formed abutting the outside of the firebox at the top of the firebox. The top air chamber is formed by an outer top wall which is spaced from the top wall of the firebox. The upper end of the back air chamber is connected to the rear end of the top air chamber so that air can flow from the back air chamber to the top air chamber.

A substantially rectangular opening is provided in the top chamber facing the front of the heating unit. Air flows through the top air chamber and out the rectangular opening. The back and top air chambers thus form a heat jacket wherein air is heated and blown out into the room or building which is to be heated.

A plurality of elongate, upstanding fins are provided in the top air chamber. The fins are welded to the top wall of the firebox and extend upwardly into the top air chamber so that air flowing through the top air chamber flows along the upstanding surfaces of the fins. Heat is conducted through the fins from the top wall of the firebox and is then transferred to the air flowing along the surfaces of the fins.

Additional objects and features of the invention will become apparent from the following detailed description, taken together with the accompanying drawings.

THE DRAWINGS

A preferred embodiment of a heating unit in accordance with the present invention and representing the best mode presently contemplated of carrying out the invention in actual practice is illustrated in the accompanying drawings, in which.

DETAILED DESCRIPTION OF THE ILLUSTRATED EMBODIMENT

Figure 1:
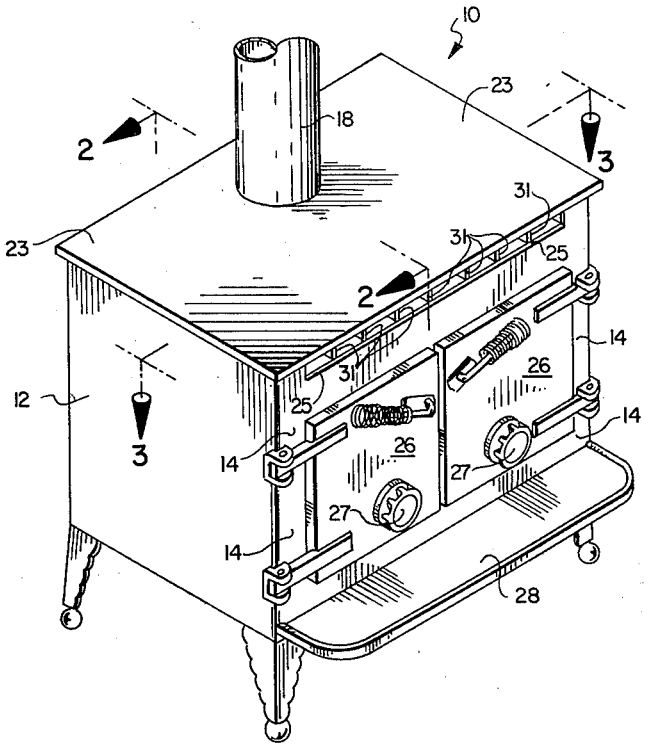
FIG. 1 is a pictorial view of the heating unit.
Figure 3:
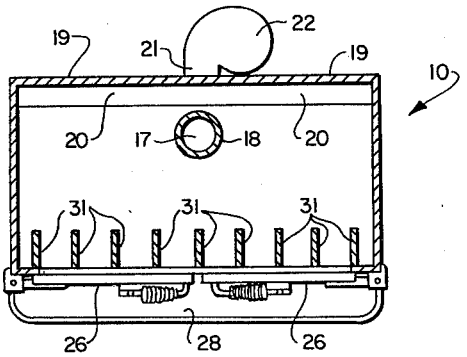
FIG. 3 is a horizontal, cross-sectional view taken along line 3—3 of FIG. 1.

Referring now to the drawings:

In the illustrated preferred embodiment, the heater unit 10 of the present invention includes a firebox of generally rectangular shape. As shown, the firebox has a bottom 11, upstanding, spaced apart side walls 12, a back wall 13, a partially open front wall 14, and a top 15, with the side walls, back wall and front wall interconnected by the bottom and top. The inside of the box forms a combustion chamber 16.

A chimney opening 17 is provided in the top 15 of the firebox near the rear end of the top 15 and centered between the side walls 12. The chimney opening could also be located in the back wall 13 or either of the side walls 12 as well as in the top 15, so as to provide a heater with a back or side flue connection rather than the top connection which is illustrated. A chimney or flue 18 is connected to the opening 17.

A back outer wall 19 cooperates with the back wall 13 of the firebox to form a back air chamber 20. An intake duct 21 having its intake outside of the back of the heating unit 10 is connected into the back air chamber 20, and an electric fan unit 22 is associated with the duct 21 for blowing air drawn from the back and beneath the heating unit 10 into the back air chamber 20. The bottom and side edges of the back air chamber 20 are formed by extensions of the bottom 11 and side walls 12 of the firebox, respectively.

Figure 2:
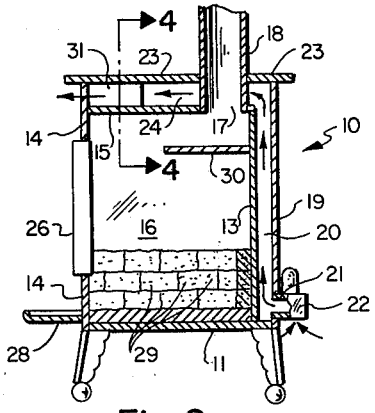
FIG. 2 is a vertical, cross-sectional view taken along line 2—2 of FIG. 1.

A top outer wall 23 cooperates with the top 15 of the firebox to form a top air chamber 24. The front wall 14, and side walls 12 extend vertically a short distance above the top 15 of the firebox to define the front and side edges, respectively, of the top air chamber 24. The rear edge of the top outer wall and the top edge of the back outer wall are connected together at the top, back side of the heating unit 10. As shown in FIG. 2, the back air chamber 20 and the top air chamber 24 are thus connected together in flow communication with each other at the top, back side of the heating unit 10.

The outer top wall 23 has an opening therein through which the chimney or flue 18 passes. The vertical extension of the front wall 14, which forms the front edge of the top air chamber 24, has a substantially rectangular opening 25 therein. The opening 25 forms a distribution opening through which heated air flows from the top air chamber 24 into the room containing the heater unit 10.

The front wall 14 also has an opening into the firebox, and a pair of doors 26 are attached to the front wall 14 to close the opening to the firebox. Wood or coal is introduced into the firebox through the opening in the front wall 14 when the doors 26 are opened. Once a fire is burning in the firebox, the doors 26 are closed. The doors 26 have draft control means 27 associated therewith as is well known in the art for controlling the amount of combustion air introduced therethrough into the firebox. An ashpan 28 can be positioned immediately below the doors 26 to aid in the removal of ashes from the firebox through the open doors 26.

The inside of the firebox preferably has a firebrick lining 29 on the bottom wall 11 thereof and at least partially up the back wall 13 and side walls 12, as is shown in FIG. 2. A baffle plate 30 can be provided in the firebox extending outwardly from the back wall 13 toward the front wall 14 as shown in FIG. 2. The baffle plate 30 is advantageously spaced about 3 to 6 inches or so from the top of the firebox, and extends sufficiently from the back wall 13 of the firebox to project over the chimney opening 17. The baffle plate 30 forces the hot combustion gases to swirl therearound and then flow past the broad inside face of the top 15 of the firebox.

Figure 4:
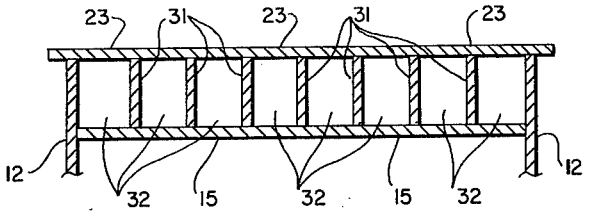
FIG. 4 is a cross-sectional view taken on line 4—4 of FIG. 2.

A plurality of spaced apart, parallel, elongate, upstanding metal fins 31 are welded to the top 15 of the firebox. Advantageously, the fins 31 project upwardly from the top 15 to the top outer wall 23 as shown in FIG. 4. Parallel flow channels 32 are thus defined between mutually adjacent fins so that the flow of air through the top air chamber 24 passes longitudinally through the flow channels 32. The longitudinal surfaces of the fins 31 preferably are oriented substantially normal to the front wall 14 of the heating unit 10, with mutually respective ends of the fins 31 being positioned substantially adjacent to the rectangular opening 25 in the top air chamber 24. The fins 31 preferably have a longitudinal dimension of at least about three inches, and, thus, as illustrated, the fins 31 extend at least about three inches into the top air chamber 24 from the rectangular opening 25 therein.

Although not illustrated, the fins 31 could be positioned anywhere within the top air chamber 24. However, positioning the fins 31 as illustrated has the benefit of forming an aesthetically appealing grid in the rectangular opening 25. Another modification which is not illustrated can be effected by shortening the depth of the top outer wall 23 so that it does not extend all the way to the front wall 14 of the firebox. In such a modification, the front wall 14 would not project upwardly beyond the top 15 of the firebox, and an end plate having a rectangular opening could, if desired, be placed over the otherwise open front end of the top air chamber. Otherwise, the opening formed by the front end of the outer top wall 23 could be left completely exposed and, thus, form the rectangular opening from the top and chamber. The fins would be positioned within the top air chamber as described herein, preferably extending longitudinally into the top air chamber from the rectangular opening therein.

In operation, wood or coal is burned in the combustion chamber, thereby heating the walls of the firebox and in particular, the back wall 13 and top wall 15. Air is blown into the back air chamber 20 by the electric fan 22, and the air flows through the back air chamber to the top air chamber 24 and then through the flow channels 32 into the room in which the heater unit 10 is situated. As the air flows over the back wall 13 and the top 15 of the firebox, heat is transferred thereto. The fins 31 readily conduct heat therethrough from the top 15 of the firebox, and the conducted heat is then transferred to the air flowing past the upstanding surfaces of the fins 31. The fins 31 render the heating unit 10 of this invention much more efficient than similar units which have forced air jackets around the firebox but lack the heat transferring fins of the present invention.

Although a preferred embodiment of my invention has been herein disclosed and illustrated, it is to be understood that the present disclosure is made by way of example and that various modifications are possible without departing from the subject matter coming within the scope of the following claims, which subject matter I regard as my invention.

I claim:

1. A wood or coal burning, heating unit comprising a firebox having a bottom, spaced upright side walls, a back wall interconnecting the side walls, a front wall interconnecting the side walls and having a door opening therethrough, and a sheet metal top interconnecting said side, back and front walls, said sheet metal top forming substantially the entire top of said firebox, whereby the interior of said firebox will serve as a combustion chamber;

a back outer wall forming a back chamber with the back wall of the firebox;

an air inlet duct connected into the back chamber;

means for providing a flow of air through the air inlet duct and into the back chamber;

an outer top wall spaced from said sheet metal top of said firebox, with said front wall and said spaced upright side walls extending upwardly beyond said firebox to interconnect with the front edge and side edges, respectively, of said outer top wall to form a top chamber positioned over and covering substantially the entire top of the firebox;

means for connecting the upper end of said back chamber in flow communication with said top chamber so that air can flow from said back chamber to said top chamber;

a substantially rectangular opening along the top of the front wall of said heating unit communicating directly with said top chamber, said opening facing from the front of the heating unit so that heated air flows from said top chamber outwardly from the rectangular opening in the top of the front wall of said heating unit;

a plurality of spaced apart, elongate, upstanding metal fins welded to said sheet metal top of said firebox said fins being disposed upwardly from said sheet metal top into said top chamber to form flow channels in said top chamber between mutually adjacent fins so that the flow of air through said top chamber passes through said flow channels, whereby heat is conducted through said fins from said sheet metal top of said firebox and then transferred from the fins to the air flowing through said flow channels; and door means connected to the front wall of said firebox and adapted to close the door opening therein.

2. A heating unit as in claim 1, wherein the fins are parallel to each other and oriented with their longitudinal surfaces being substantially normal to the front wall of the heating unit.

3. A heating unit as in claims 1 or 2, wherein mutually respective ends of the fins are positioned adjacent to the rectangular opening in the top chamber, with the fins extending at least about three inches into the top chamber from said rectangular opening.

4. A heating unit as in claims 1, 2, or 3, wherein the means for providing a flow of air into the back chamber comprises an electric fan connected in combination with the air inlet duct on the back chamber.

* * * * *